US010226793B2

(12) United States Patent
Gomez

(10) Patent No.: US 10,226,793 B2
(45) Date of Patent: Mar. 12, 2019

(54) WASTE SORTING DEVICE HAVING AN IMPROVED ROTARY SCREEN

(71) Applicant: GREEN CREATIVE, Sucy-en-Brie (FR)

(72) Inventor: Remi Gomez, Paris (FR)

(73) Assignee: GREEN CREATIVE, Sucy-en-Brie (FR)

( * ) Notice: Subject to any disclaimer, the term of this patent is extended or adjusted under 35 U.S.C. 154(b) by 0 days.

(21) Appl. No.: 15/528,687

(22) PCT Filed: Nov. 24, 2015

(86) PCT No.: PCT/EP2015/077574

§ 371 (c)(1),
(2) Date: May 22, 2017

(87) PCT Pub. No.: WO2016/083423

PCT Pub. Date: Jun. 2, 2016

(65) Prior Publication Data

US 2017/0266696 A1 Sep. 21, 2017

(30) Foreign Application Priority Data

Nov. 24, 2014 (FR) ..... 14 61382

(51) Int. Cl.
*B07B 1/24* (2006.01)
*B07B 1/52* (2006.01)
(Continued)

(52) U.S. Cl.
CPC ..... *B07B 1/24* (2013.01); *B07B 1/524* (2013.01); *B07B 13/003* (2013.01); *B65B 55/24* (2013.01); *B07B 13/075* (2013.01)

(58) Field of Classification Search
CPC .... B07B 1/18; B07B 1/22; B07B 1/24; B07B 1/26; B07B 1/52; B07B 1/522;
(Continued)

(56) References Cited

U.S. PATENT DOCUMENTS 3,695,448 A * 10/1972 Johansson ..... D21C 9/18 210/394
4,056,475 A * 11/1977 Sander ..... B01D 33/465 209/390

(Continued)

FOREIGN PATENT DOCUMENTS

FR 2149927 A5 3/1973
WO WO 2014/076285 A1 5/2014

*Primary Examiner* — Joseph C Rodriguez
*Assistant Examiner* — Kalyanavenkateshware Kumar
(74) *Attorney, Agent, or Firm* — Muncy, Geissler, Olds & Lowe, P.C.

(57) ABSTRACT

A processing equipment for collecting matter adhering to a surface of packages to be processed, the equipment including: a rotary cylindrical drum provided with orifices forming a screen for retaining the packages and for allowing the matter for collection to pass through; a brush roller mounted in the drum in order to brush the inside surface of said drum; a motor for driving the brush and the rotary drum in rotation; an outer casing for collecting the matter that has passed through the wall of the rotary drum during processing; a compression device against the inside face of the drum mounted inside the rotary drum in the immediate vicinity of the inside surface of the drum.

13 Claims, 3 Drawing Sheets

(51) Int. Cl.
*B07B 13/00* (2006.01)
*B65B 55/24* (2006.01)
*B07B 13/075* (2006.01)

(58) Field of Classification Search
CPC .. B07B 1/524; B07B 4/06; B07B 7/00; B07B 7/08; B07B 7/083; B07B 13/04; B07B 13/075
USPC ..... 209/285, 288, 293, 294, 296, 298, 299, 209/389, 390, 689
See application file for complete search history.

(56) References Cited

U.S. PATENT DOCUMENTS 4,167,975 A * 9/1979 Fahrenholz ..... E01H 12/00 171/12
4,469,230 A * 9/1984 Gorlitz ..... B07B 1/22 209/369
4,896,835 A * 1/1990 Fahrenholz ..... B07B 1/12 209/234
6,253,928 B1 * 7/2001 Weber ..... B07B 1/22 209/384
2007/0084765 A1 * 4/2007 Tse ..... B02C 17/007 209/689

* cited by examiner

WASTE SORTING DEVICE HAVING AN IMPROVED ROTARY SCREEN

The invention relates to sorting waste, in particular with the aim of recycling or eliminating them. The invention more particularly relates to a device for cleaning packages in the field of waste reprocessing, in particular waste from the retail industry.

BACKGROUND OF THE INVENTION

In the field of processing waste from the retail industry in particular, processing equipment is known from document WO A 2014 076285 for collecting matter adhering to the outside surface of packages to be processed and that have already been shredded. Such equipment is shown in accompanying FIG. 1.

This equipment 1 comprises a rotary cylindrical drum 4 provided with orifices 6 forming a screen for retaining the packages and for allowing the matter for collection to pass through, a brush roller 7 mounted inside the rotary drum in order to brush the inside surface of said drum, motor means 12 for driving the brush 7 and the cylindrical drum 4 in rotation, and an outer casing 3 for collecting the matter from the packages 13 introduced into the cylindrical drum 4 and that have passed through the wall of said cylindrical drum 4.

Thus, when a package 13 is introduced into said equipment 1, it is caught up by the brush 7 to be brushed and brought into the contact zone in which the brush makes contact with the inside surface of the drum 4, a zone in which the package is subjected to intense brushing. This has the effect of removing matter adhering to the surface of said package 13. Once the package has left the contact zone, it is ejected by the brush 7 towards the top region, in order to follow a path that is substantially circular, during which it jumps over the brush 7 and hits the drum 4, before once again being caught up by the brush that returns it into the contact zone in order once again to be subjected to intense brushing. On each jump outside of the contact zone, the package being processed loses an additional portion of the matter adhering to its surface, said matter being spun off when the package passes over the brush while gyrating.

OBJECT OF THE INVENTION

The invention aims to improve the above-mentioned equipment in particular by improving its ability to extract viscous matter from the package and by facilitating passage of such adherent matter through the orifices of the rotary drum.

SUMMARY OF THE INVENTION

To this end the invention provides processing equipment for collecting matter adhering to a surface of packages to be processed as waste, said equipment comprising:

- a rotary cylindrical drum provided with orifices forming a screen for retaining the packages and for allowing the matter for collection to pass through;
- a brush roller mounted in the drum in order to brush the inside surface of said drum;
- motor means for driving the brush and the rotary drum in rotation; and
- an outer casing for collecting the matter that has passed through the wall of the rotary drum during processing.

In addition to the above-mentioned elements, the processing equipment comprises compression means for compressing waste against the inside face of the drum, which means are mounted inside the rotary drum in the immediate vicinity of said drum. More generally, the compression means guide waste in a space that gets progressively smaller as the waste approaches the wall of the drum. This ensures that the package and its content are compressed against the wall of the drum and thus that the content is extracted from the package.

Advantageously, the compression means comprise a roller. In particular, the roller improves the ability of the equipment to extract substances (e.g. cured meat) from a package using a "rolling pin" technique, which a brush alone cannot do.

Preferably, the compression means are arranged to exert a first function and a second function.

Thus, advantageously, the first segment is a segment referred to as an "extracting" segment, which has an outside surface provided with spikes arranged to puncture the packages, and the second segment is a segment referred to as the "flattening" segment, which has a smooth outside surface arranged to expel the material from the packages for pushing through the orifices of the drum.

An improvement in the performance of the equipment can thus be obtained.

Also advantageously, in this embodiment, the processing equipment includes a deflector mounted at the inlet of the drum and arranged to direct the packages towards the extracting segment of the roller.

The risk of a package escaping perforation is thus limited.

In a variant, the roller has segments having diameters that increase going towards the outlet of the drum.

According to a particular characteristic, said equipment includes resilient return means for returning the compression means to a normal operating position in order to flatten the packages.

Thus, advantageously, the return means include a controllable actuator for bringing the compression means in their normal operating position towards a cleaning position in which the compression means are in contact with the bristles of the brush.

The compression means may thus be free from packages or matter that could remain stuck thereto.

Also advantageously, the equipment includes drive means for driving the packages along the drum. In a preferred embodiment, the drive means include implanting brushing elements of the brush in a helical pattern in order to facilitate moving the packages along the equipment while they are being processed.

BRIEF DESCRIPTION OF THE FIGURES

The invention can be better understood on reading the following description of a particular non-limiting implementation of the invention.

Reference is made to the accompanying drawings, in which.

DETAILED DESCRIPTION OF THE INVENTION

Figure 1:
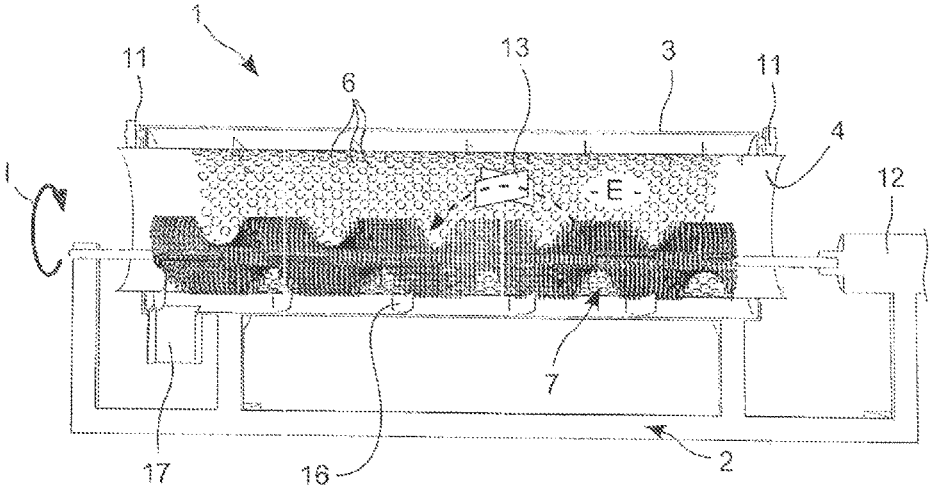
Fig. 1 (Prior art)
FIG. 1 is a view of prior art equipment, in longitudinal section, and is described above.

With reference to FIGS. 2 to 6, the processing equipment of the invention, given reference 1, comprises a frame 2 in the form of a structure formed by machine-welded steel bars, carrying a rigid casing 3 in the form of a sheet metal cylinder that extends horizontally.

The casing 3 encloses a cylindrical drum or trommel 4 in the form of a sheet metal cylinder pierced by a series of orifices 6 over the great majority of its surface in order to constitute a rotary screen, and a rotary brush roller 7 mounted inside the trommel 4.

The brush roller 7 has a diameter of the order of half the inside diameter of the trommel 4, the cylindrical casing 3 has a diameter greater than that of the trommel 4 because it surrounds said trommel. Other diameter values may be selected as a function of the general arrangement that is used.

The trommel 4 is mounted to rotate while being guided at each of its ends by three rotary wheels 11 disposed at 120 degrees about its axis of rotation. The trommel 4 is driven in rotation by a motor (not shown in the figures). The entire device advantageously slopes so that the end of the trommel 4 through which the packages 13 to be processed are inserted is higher than the other end of the trommel 4 through which the packages that have been processed are discharged.

The brush 7 is driven in rotation by a motor 12 that is carried by the frame 2, at one end of the equipment. The speed of rotation of the brush 7 is much greater than that of the trommel 4.

The operation of the brush 7 is described below. In operation, the brush 7 and the trommel 4 both turn in the same direction, which is in the lefthanded direction referenced I in FIG. 1, which has the effect of stirring the packages 13 to be processed present in the inside space E defined by the trommel 4 and the brush 7.

In concrete terms, each package 13 follows a circular path during processing: it is caught up by the brush 7 so as to be brushed and moved into the contact zone, i.e. the zone in which the brush bears against the inside surface of the trommel 4, where said element is brushed.

This has the effect of removing matter adhering to the surface of said package 13. Once the package has left the contact zone, it is ejected by the brush 7 towards the top region, in order to follow a path that is substantially circular during which it jumps over the brush 7, possibly bounces on the inside surface of the trommel 4 before once again being caught up by the brush 7 to pass into the contact zone.

In its path, it also frequently happens that, while falling, the package lands initially on the brush 7, so that the brush throws it against the inside surface of the trommel 4, which has the effect of further increasing efficiency with which adherent matter is removed.

During each skipping cycle, the package 13 being processed loses an additional portion of the matter adhering to its surface, said matter being brushed by the brush 7 on each passage into the contact zone, and also being spun off when the package passes over the brush while gyrating.

The equipment of the invention further includes a roller 20 that improves recuperation of matter contained in the packages. The roller 20, which is of generally cylindrical shape, is mounted inside the trommel 4 so as to roll on the inside surface of the trommel 4 under the action of resilient return means given overall reference 40.

Figure 2:
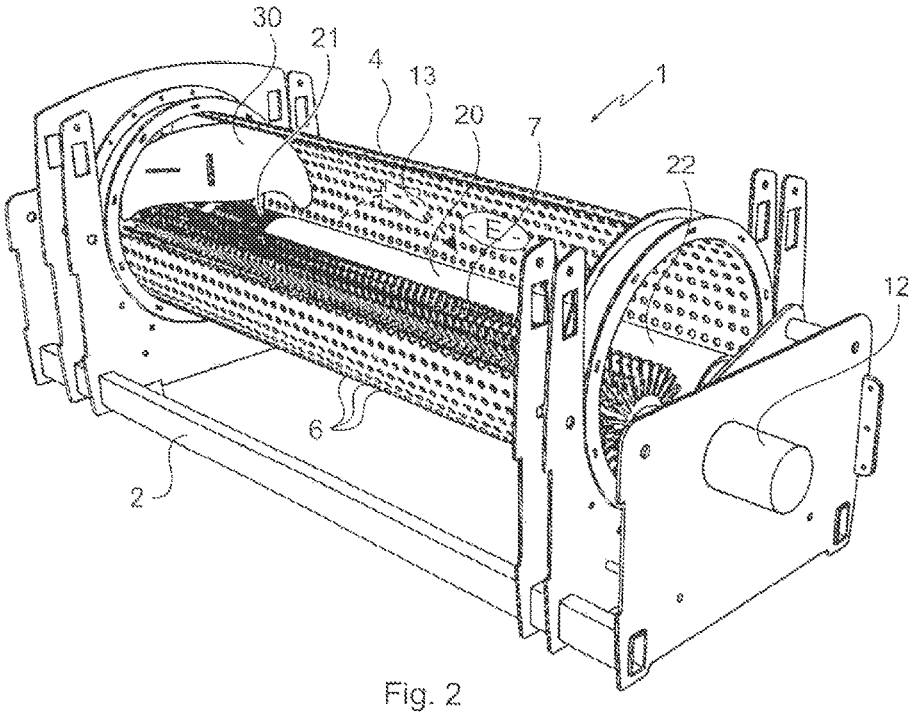
FIG. 2 is a cut-away view in perspective of the equipment of the invention, the rear of the equipment being more particularly visible in the foreground.
Figure 3:
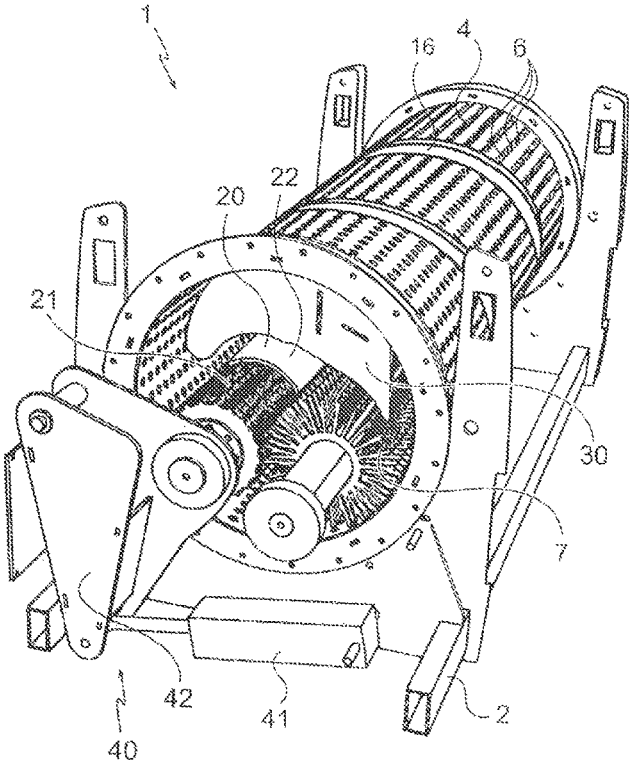
FIG. 3 is a fragmentary view in perspective of the equipment of the invention, the front of the equipment being more particularly visible in the foreground.

The roller 20, which can be seen more clearly in FIGS. 2 and 3, comprises two successive segments along its length: A first segment referred to as the "extracting" segment 21 having an outside surface provided with spikes arranged to extract matter from the packages, and possibly to shred said packages, and a second segment referred to as the "flattening" segment 22 having a smooth outside surface arranged to force the material for collection to pass through the trommel 4. In this example, the segments 21, 22 have the same maximum outside diameter.

Said roller 20 is carried by a shaft 23 having ends 23.1 each rotatably mounted on a first end of a respective cradle portion 42 that is generally L-shaped. Each cradle portion 42 has a second end that is secured to an end of a controllable actuator 41 forming part of the resilient return means 40. Each of the controllable actuators 41 in this example is a double-acting jack and has an opposite end hinged to the frame 2.

Each cradle portion 42 is connected to the frame 2 between its first and second ends in order to pivot about an axis X. The cradle 42 thus forms a lever that enables the controllable actuator 41 to cause the roller 20 to pivot about the axis X between a normal operating position, visible in particular in FIG. 4, and a cleaning position visible in FIG. 5.

Figure 4:
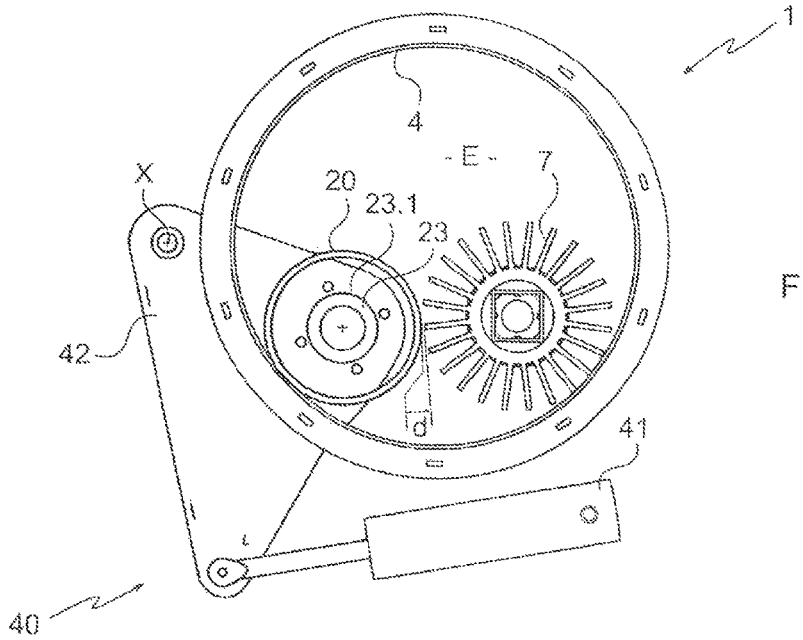
FIG. 4 is an end view of the equipment showing the roller in its normal operating position.

In its normal operating position visible in particular in FIG. 4, the roller 20 has its outside surface, and more particularly the outside surface relative to the rolling segment 22, bearing against the inside surface of the trommel 4. The controllable actuator 41 resiliently holds the roller 20 in this position by applying a force of several tens of kilonewtons on the roller by means of the leverage effect obtained from the cradle portions 42. In this position, and in this particular implementation, the outer surface of the roller 20 is at a distance d from the bristles of the brush 7. Still in this particular implementation, d is of the order of 5 millimeters (mm). However, other values could be selected as a function of the general disposition that is used. In its normal operating position, the roller 20 is driven in rotation by the trommel 4 and rolls on the inside surface of said screen.

Thus, in the normal operating position, the spikes of the segment 21 of the roller 20 puncture the packages by pressing them against the inside surface of the trommel 4 and the smooth surface of the segment 22 flattens the packages 13 and/or the matter for collection, and thus promotes passage of said matter through the orifices 6 of the drum 4 towards the casing. The roller 20 performs two functions simultaneously: a first, extracting and/or shredding function; and a second, flattening function.

Figure 5:
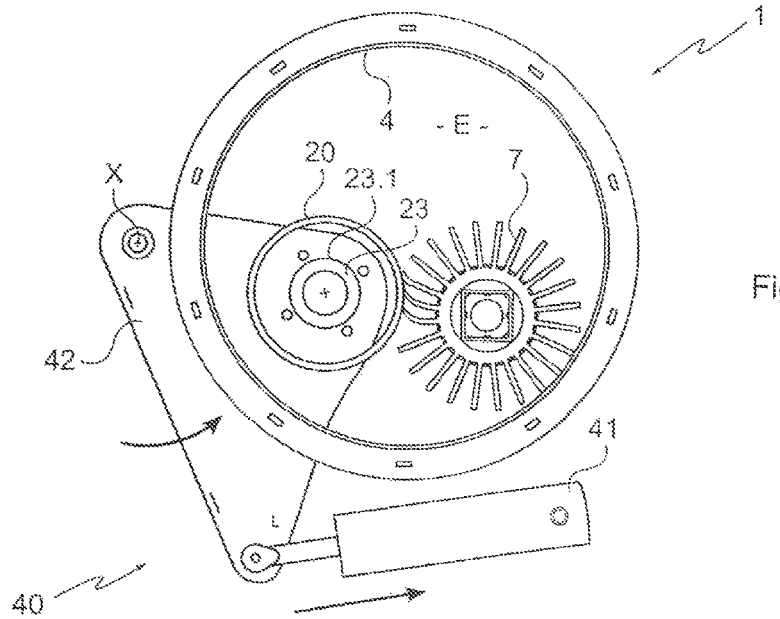
FIG. 5 is a view similar to FIG. 4 showing the roller in the cleaning position.

As can be seen in FIG. 5, the roller 20 in the cleaning position has its outside surface in contact with the bristles of the brush roller 7, driving cleaning of said outside surface of the roller.

In order to direct the packages 13 advantageously towards the extracting segment 21 of the roller 20, a deflector 30 in the form of a plate is disposed at the inlet of the trommel 4. Thus, said packages 13 and their matter for collection are extracted and possibly shredded before being flattened by the rest of the roller 20 or carried away by the brush roller 7.

Furthermore, in this embodiment the outside surface of the trommel 4 is provided with a blade assembly 16 arranged in a helical pattern in order to drive the extracted matter along the casing that contains it, with the aim of discharging it at one end of the casing 3. In addition, a bottom vertical duct 17 is provided that is connected to a bottom opening of the casing 3 situated at the end of the casing that is remote from the motor 12.

The dimensions of the orifices 6 of the drum 4 are selected to retain the shredded and lacerated packages 13, while allowing the matter they contain and that adheres to said packages to pass through. The passage of the matter in question is further facilitated by the centrifugal effect of the trommel 4 rotating, in such a manner that said matter is then found in the casing 3, the shredded packages being retained inside the space E.

Naturally, the invention is not limited to the embodiment described but covers any variant coming within the ambit of the invention as defined by the claims.

In particular, although in this embodiment waste is compressed by a pivotally mounted cylindrical roller, the invention also applies to other means of compression such as for example, a stationary cylindrical roller, a stationary plane scraper positioned to form an acute angle with the inside surface of the drum, or a stationary metal sheet of cross section that is substantially comma-shaped. Such a scraper or such a metal sheet may present a portion provided with claws (first extracting function) and a second guide portion (flattening). More generally, the compression means guide waste in a space that gets progressively smaller as the waste approaches the inside surface of the drum. The compression means of the invention may also include a compression cone, having an axis of rotation that may optionally be parallel to the axis of rotation of the drum, a cylinder of section that is optionally octagonal.

The compression means may also be arranged to perform other processing functions optionally in addition to the above-mentioned functions. In particular, for the above-described roller, consideration can be given to a third segment provided with bristles similar to those of the brush.

Figure 6:
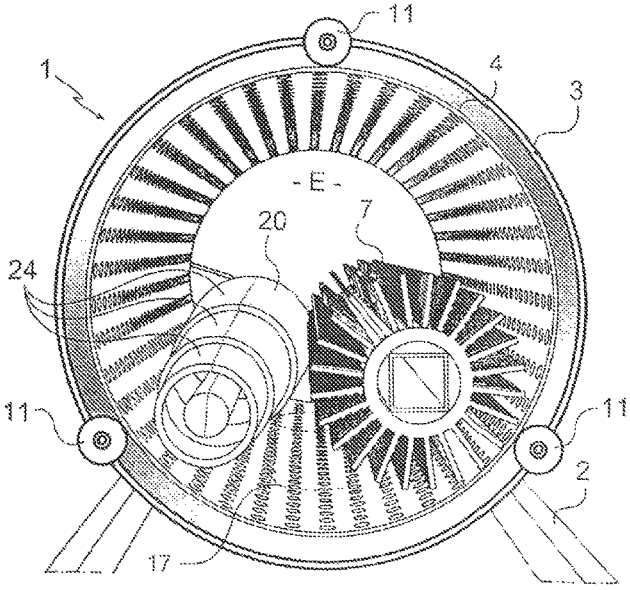
FIG. 6 is an end view of the equipment in an alternative embodiment showing the roller with segments of increasing diameter going towards the outlet of the drum.

In another embodiment of the invention visible in FIG. 6, the segments of the roller 20 have diameters that increase going towards the outlet of the drum 4. Thus, by way of example, segments 24 dedicated to flattening push harder and harder on the matter for collection so as to ensure gradual passage of said matter through the orifices 6 into the casing 3.

In a variant, the brushing elements of the brush 7, i.e. its bristles, are implanted along said brush in a helical pattern in order to drive the packages 13 along the trommel 4 while they are being processed, in such a manner as naturally to promote their discharge towards the outlet of one of the ends of the trommel 4. This may be combined with sloping the trommel in such a manner as to have the outlet lower than the inlet, with gravity naturally driving the packages towards the outlet. Provision may also be made for an opposite slope in such a manner that the matter for collection moves back towards the inlet, while the helical shape of the brush causes packages that have been processed to move upwards.

In the embodiment shown, the roller 20 is mounted to rotate freely in the drum 4. Nevertheless, it is entirely possible to envisage a configuration in which the rotation of the roller 20 is controlled.

There is no doubt that several other drive systems for extracted matter could be used. In particular, mention may be made of a movable element implanted inside the casing and moved with reciprocating motion to push the extracted matter towards an end of the equipment.

Furthermore, although in this embodiment packages are driven by implanting brushing elements arranged in a helical pattern along the brush, the invention also applies to means for driving packages that are distinct from the brush, such as for example, a wormscrew mounted in the drum parallel to the brush, helical blades mounted on the inside surface of the drum, a helical element mounted stationary inside the drum, or a mechanical pusher moving forwards inside the drum. More generally, the means for driving packages create a flow of packages along the drum from the end of the drum at which they were introduced to the end of the drum via which the packages are discharged after processing.

The invention claimed is:

1. A processing equipment for collecting matter adhering to a surface of packages to be processed as waste, said equipment comprising:

- a rotary cylindrical drum provided with orifices forming a screen for retaining the packages and for allowing the matter for collection to pass through;
- a brush roller mounted inside the rotary drum in order to brush the inside surface of said rotary drum;
- motor means for driving the brush roller and the rotary drum in rotation;
- an outer casing for collecting the matter that has passed through the wall of the rotary drum during processing;
- compression means for compressing against an inside face of the rotary drum, which compression means are mounted inside the rotary drum in the immediate vicinity of the inside surface of said drum so that the packages and the matter are compressed against the inside face of the rotary drum and that the matter is pushed through the orifices of the rotary drum; and
- resilient return means for returning the compression means to a normal operating position in order to flatten the packages.

2. The equipment according to claim 1, wherein the compression means are arranged to perform a first function and a second function respectively, including a flattening function for flattening packages in order to force the matter for collection to pass through the rotary drum.

3. The equipment according to claim 1, wherein the compression means comprise a roller.

4. The equipment according to claim 2, wherein the roller includes at least a first segment and a second segment performing the first function and the second function respectively, the first segment being a segment referred to as an "extracting" segment, which has an outside surface provided with spikes arranged to extract matter from the packages, and the second segment being a segment referred to as the "flattening" segment, which has a smooth outside surface arranged to force the material for collection to pass through the rotary drum.

5. The equipment according to claim 4, wherein the processing equipment includes a deflector arranged to direct the packages advantageously towards the extracting segment of the roller.

6. The equipment according to claim 3, wherein the segments of the roller have diameters that increase going towards the outlet of the rotary drum.

7. The equipment according to claim 1, wherein the return means include a controllable actuator for bringing the compression means from their normal operating position towards a cleaning position in which the compression means are in contact with the bristles of the brush.

8. The equipment according to claim 1, wherein the compression means are carried by a shaft having ends that are secured to a cradle on which the return means act via a lever.

9. The equipment according to claim 1, including drive means for driving the packages along the drum.

10. The equipment according to claim 9, wherein the drive means include sloping of the drum relative to the horizontal in order to facilitate admission and discharge of packages to be processed.

11. The equipment according to claim 1, wherein the drum slopes relative to the horizontal in order to facilitate discharge of extracted matter.

12. The equipment according to claim 1, wherein the drive means include implanting brushing elements of the brush in a helical pattern in order to facilitate moving the packages along the equipment while they are being processed.

13. The equipment according to claim 1, wherein the drum is provided with blades on its outside surface, which blades are arranged in a helical disposition in order to push the extracted matter along the inside surface of the casing when the drum turns.

* * * * *